US007814959B2

(12) United States Patent
Karenbauer

(10) Patent No.: US 7,814,959 B2
(45) Date of Patent: Oct. 19, 2010

(54) METHOD OF MAKING A CAST METAL PRODUCT INCLUDING A THREE-DIMENSIONAL IMAGE, AND A PRODUCT MADE BY SAID METHOD

(75) Inventor: Michael J. Karenbauer, Bethel Park, PA (US)

(73) Assignee: Matthews Resources, Inc., Wilmington, DE (US)

( * ) Notice: Subject to any disclaimer, the term of this patent is extended or adjusted under 35 U.S.C. 154(b) by 910 days.

(21) Appl. No.: 11/465,000

(22) Filed: Aug. 16, 2006

(65) Prior Publication Data

US 2007/0039707 A1 Feb. 22, 2007

Related U.S. Application Data

(60) Provisional application No. 60/709,600, filed on Aug. 17, 2005.

(51) Int. Cl.
*B22C 7/00* (2006.01)

(52) U.S. Cl. ..... 164/45; 164/4.1; 164/235

(58) Field of Classification Search ..... 164/4.1, 164/6, 34, 35, 45, 235; 700/118
See application file for complete search history.

(56) References Cited

U.S. PATENT DOCUMENTS

| | | | |
|---|---|---|---|
| 498,506 | A | 5/1893 | Cameron |
| 4,054,000 | A | 10/1977 | Lisle |
| 5,363,609 | A | 11/1994 | Hancovsky |
| 5,714,367 | A | 2/1998 | Quick et al. |
| 6,173,539 | B1 | 1/2001 | Barnes |
| 6,363,635 | B1 | 4/2002 | England |
| 6,385,499 | B1 | 5/2002 | Mattke et al. |
| 6,459,952 | B1 | 10/2002 | Dundorf |
| 6,843,303 | B2 | 1/2005 | Siak et al. |
| 2005/0038547 | A1 | 2/2005 | Walthall |

OTHER PUBLICATIONS

Long, J., "Nelson Bronze Limited", *Canadian Copper*, Issue 147, 2001.

"What is a Foundry?", gartlandfoundry.com, 2005.

Kuhn, K, "The Basics of Manufacturing Technology", ee.washington.edu, 2005.

International Preliminary Report corresponding to PCT Application No. PCT/US2006/032179 dated Mar. 17, 2009.

Extended European Search Report corresponding to EP Application No. EP 06813514 dated Sep. 17, 2009.

*Primary Examiner*—Kevin P Kerns
(74) *Attorney, Agent, or Firm*—Reed Smith LLP

(57) ABSTRACT

A process of making a cast metal product and a product made utilizing this process. A pattern used for casting the metal panel is prepared utilizing computer-aided manufacturing software to which a digital representation of an image is inputted. The software then determines a tool path height for each digital element of the digital representation. A pattern blank is placed on a computer-controlled routing table which routs the blank utilizing the tool path determined by the software program to form a three-dimensional representation of the desired image on the pattern.

5 Claims, 12 Drawing Sheets

56

METHOD OF MAKING A CAST METAL PRODUCT INCLUDING A THREE-DIMENSIONAL IMAGE, AND A PRODUCT MADE BY SAID METHOD

CROSS-REFERENCE TO RELATED APPLICATION

This application claims the benefit under 35 U.S.C. 119(e) of U.S. Provisional Application No. 60/709,600 filed Aug. 17, 2005.

FIELD OF THE INVENTION

The present invention relates in general to the process of making cast metal products, and, more specifically, to the process of making a cast metal product having a three-dimensional image using a pattern created by a computer aided manufacturing process.

BACKGROUND OF THE INVENTION

Metal casting is the process of creating objects by filling a cavity with molten metal and letting the metal cool. One common metal casting process is sand casting. In sand casting, a pattern is fabricated as a replica of a finished object. The pattern is placed in a two-piece mold containing sand and additional sand is packed tightly around the pattern. The pattern is removed from the mold creating a cavity in the sand. Molten non-ferrous metal such as aluminum, brass, copper or bronze is introduced into the cavity. After cooling, the cast object is removed from the mold. The metal casting process can be used for creating panels such as wall plaques, and lawn or memorial markers. Memorial markers are typically formed from bronze and include raised lettering which indicates the name, dates of birth and death of the deceased and may also include an epitaph in the form of a memorial prayer or verse.

Traditionally, a pattern is prepared by manually fixing raised lettering or other decorative features to a blank or pre-decorated pattern. Decorative features may include bas relief decorations. For example, a sculpture may sculpt a low profile, three-dimensional representation of the deceased's head out of clay which is then fixed to the pattern. Another known pattern preparation technique involves the use of placing a negative of the desired lettering on a photosensitive material and then exposing the material to a UV light source.

Another known pattern preparation process involves the use of a computer-aided design/computer-aided manufacturing (CAD/CAM) software program operable on a processor which controls the tool path of a routing table. In this process, line art is either scanned into or created in the computer and the elevation of the cut lines is determined by the computer operator. Once the elevation and contours are determined by the computer operator, a tool path is created for use by the CAD/CAM machine. The CAD/CAM machine is then used to route a pattern for use in the foundry. This known process is limited to the use of line art which is difficult to use to recreate detailed photograph-like images.

It has been found to be difficult to create minutely detailed, three-dimensional, photograph-like images using the above-described pattern preparation processes.

SUMMARY OF THE INVENTION

In accordance with one embodiment of the present invention, there is a process of making a cast metal panel, and a panel made utilizing this process. Also, the present invention relates to the method of making a pattern used for casting the metal panel.

A pattern used for casting the metal panel is prepared utilizing computer-aided manufacturing software to which a digital representation of an image is inputted. The present invention uses continuous tone artwork as opposed to the line art of known processes. The software determines a tool path height for each digital element of the digital representation. A pattern blank is placed on a computer-controlled routing table which routs the blank utilizing the tool path determined by the software program to form a three-dimensional representation of the desired image on the pattern. The pattern created by the process of the present invention is then used in a known casting process. The present invention is not limited to bronze casting but also applies to other non-ferrous metals such as aluminum, brass, copper, or other alloys.

BRIEF DESCRIPTION OF THE DRAWINGS

The present invention and its presently preferred embodiments will be better understood by way of reference to the detailed disclosure herebelow and to the accompanying drawings, wherein.

DETAILED DESCRIPTION OF THE PREFERRED EMBODIMENTS

Figure 1:
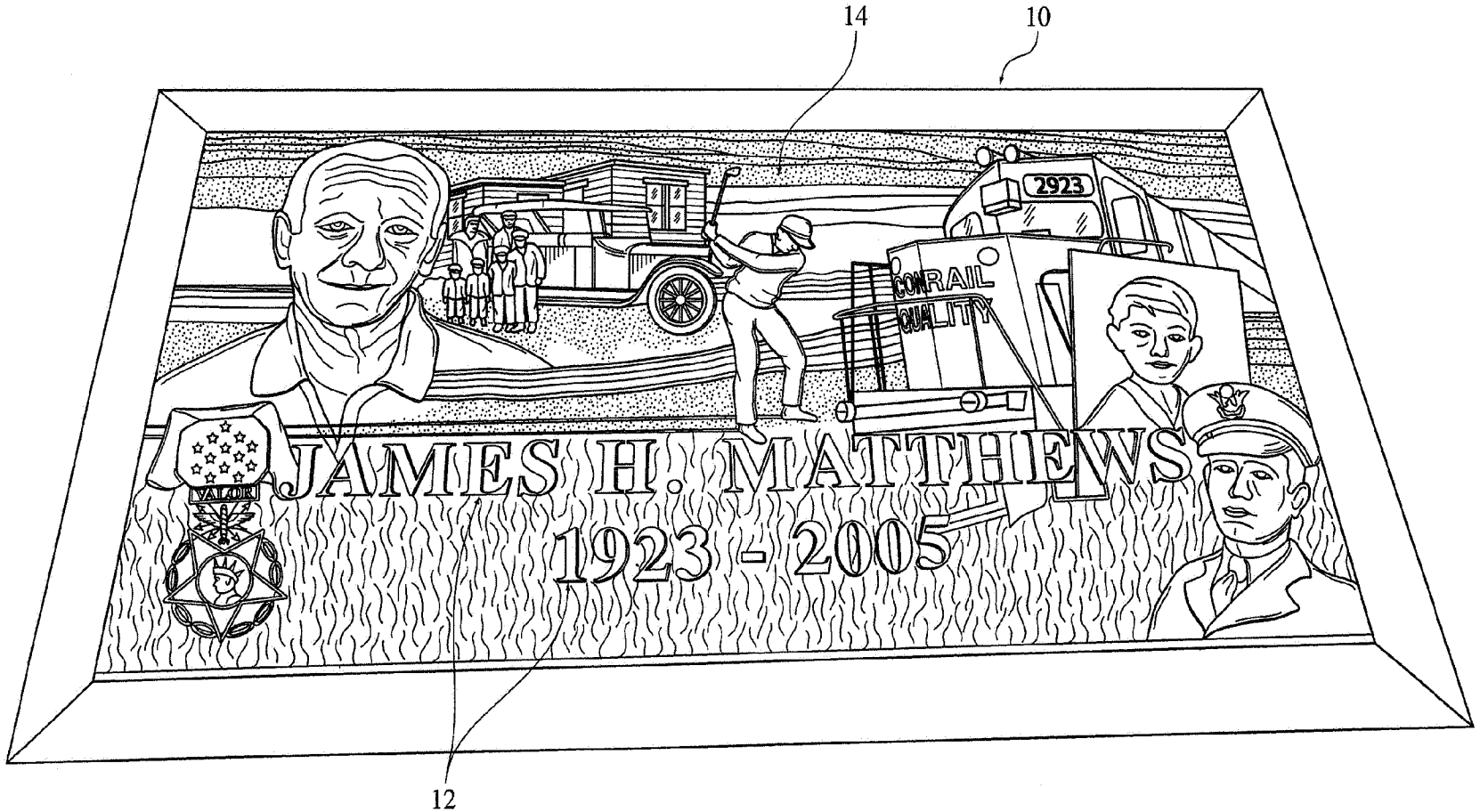
FIG. 1 is a plan view of a memorial plaque having a minutely detailed, three-dimensional, photograph-like image thereon produced according to a preferred embodiment of the present invention.

A bronze memorial plaque 10 manufactured according to a preferred exemplary embodiment of the present invention is shown in FIG. 1. As can be seen in FIG. 1, plaque 10 includes raised lettering 12 which indicates the name and dates of birth and death of the deceased, as well as a collage of minutely detailed, three-dimensional, photograph-like images 14.

Figure 2:
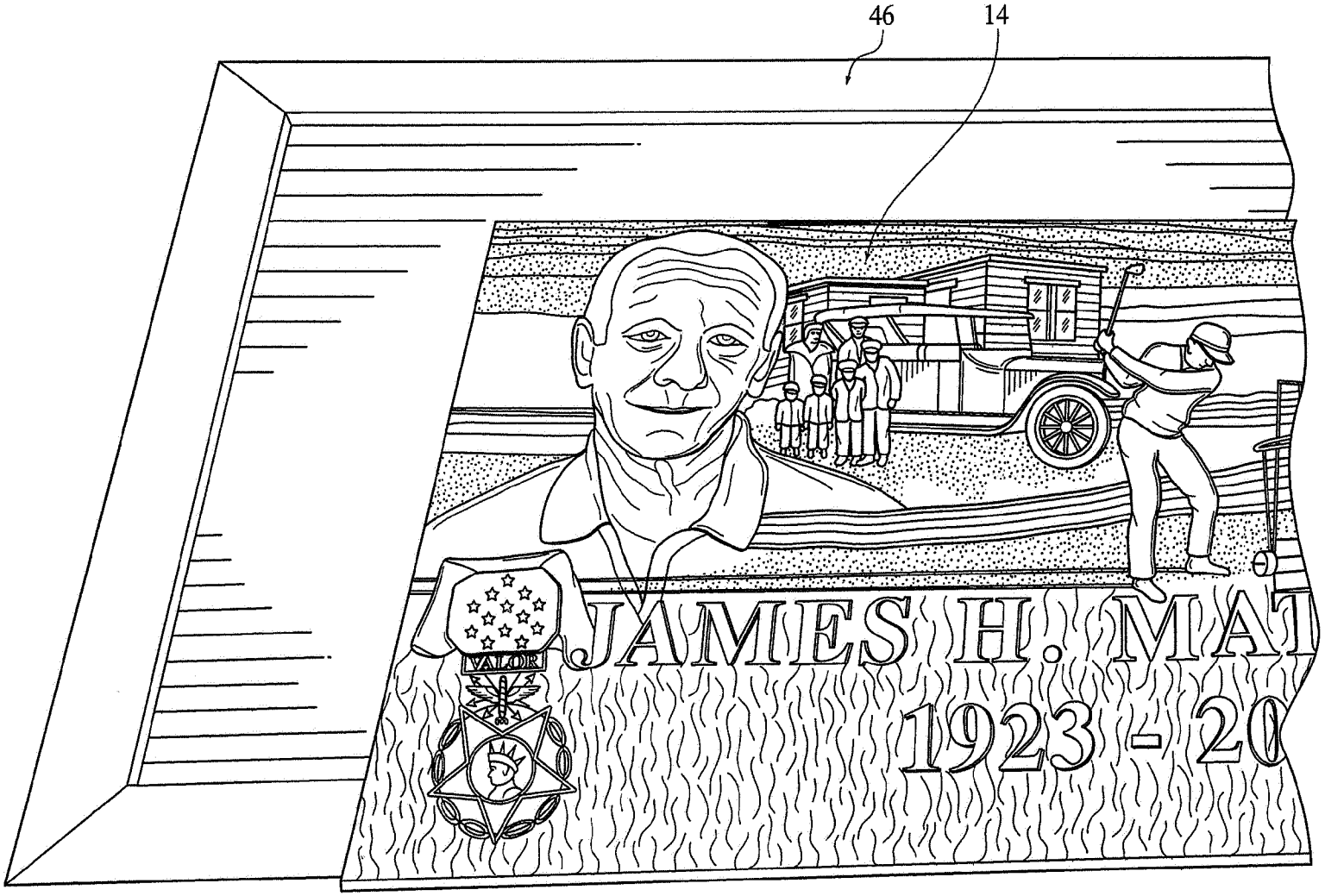
FIG. 2 is a is a plan view of a pattern produced according to a preferred embodiment of the present invention.
Figure 3:
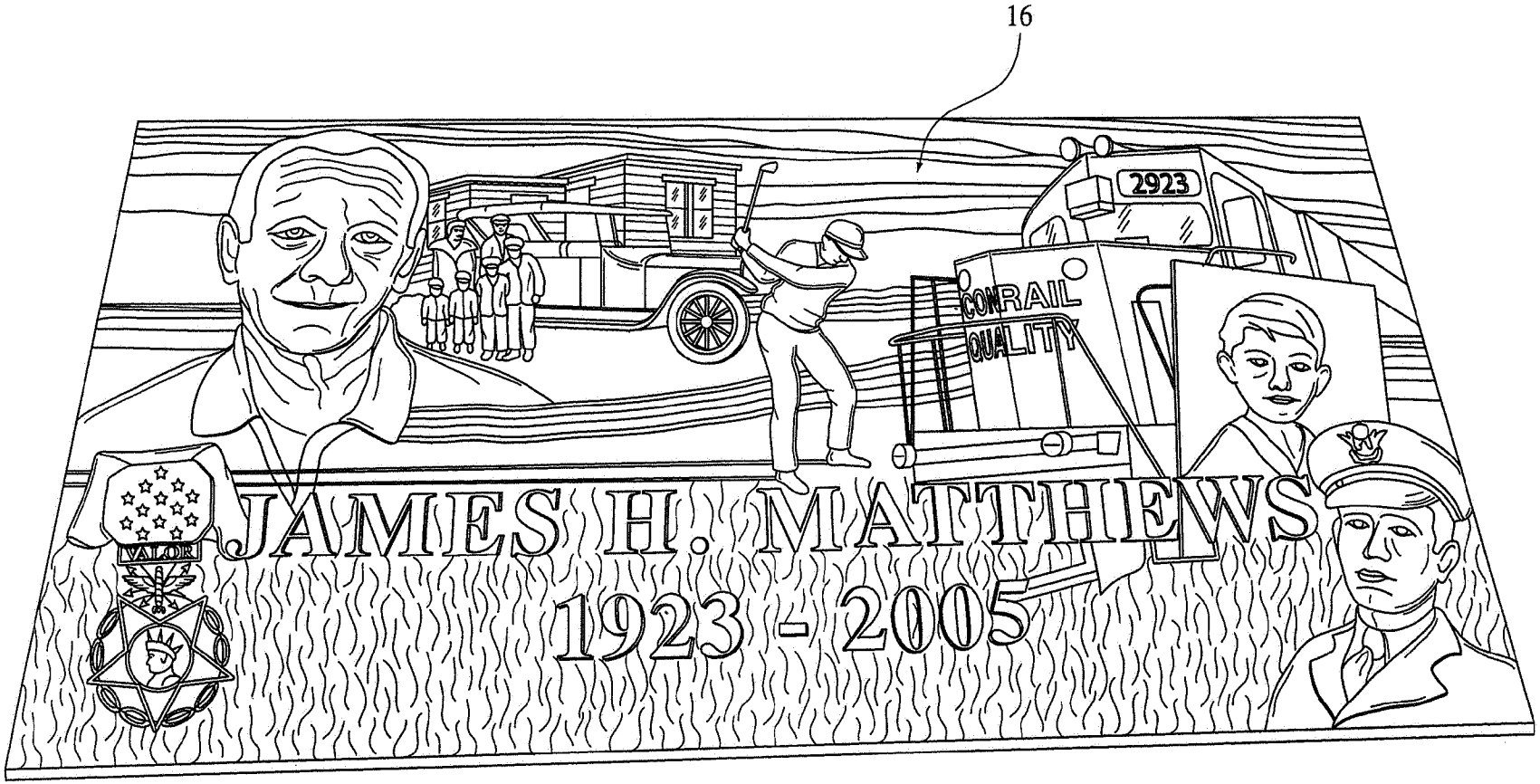
FIG. 3 is view of a frame and memorial plaque.
Figure 4:
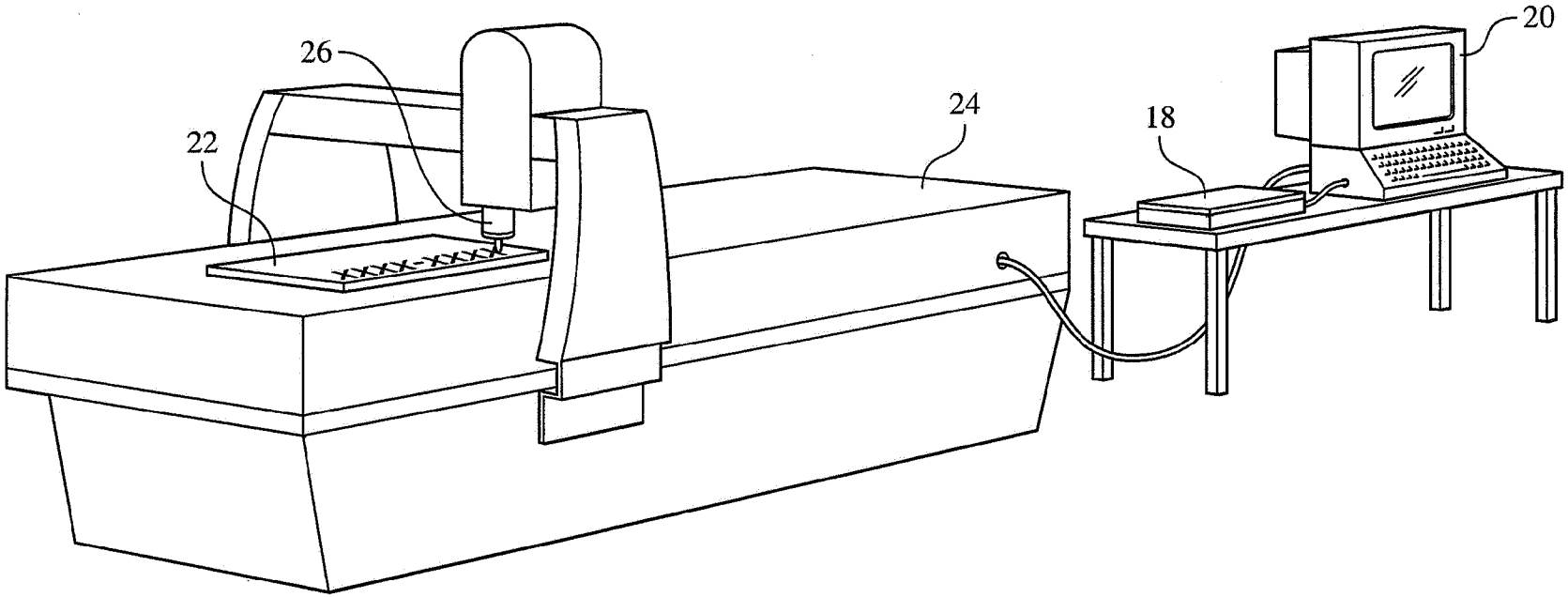
FIG. 4 is a perspective view of an example of the CAM equipment and router table arrangement.

An exemplary embodiment of the present invention is a process of making a cast metal plaque 10. Also, the present invention relates to the method of making a pattern 16 used for casting the metal plaque 10. Initially, a digital representation of a photograph or other image is obtained using a scanner 18 (FIG. 4) or other means and then inputted into a computer processor 20 having a computer-aided manufacturing (CAM) software program such as EnRoute3 or ArtCAM available from Cam Tech Industries Inc. The scanned image may be merged with other images from other sources. The software determines the elevation and contours or tool path height for each digital element of the digital representation. A pattern blank 22 is placed on a computer-controlled routing table 24 such as MultiCam MG304 available from MultiCam LP. The pattern blank 22 is preferably formed from a urethane based material but may also be formed from plastic, wood fiber board, composite stone or other materials which can be computer routed. The pattern 22 is dimensioned to be at least as long, wide and deep as the desired finished pattern 16. The router table tool 26 then routs the pattern blank 22 utilizing the tool path determined by the software program to form a three-dimensional representation of the desired image on the pattern. A finished pattern 16 having a minutely detailed, three-dimensional, photograph-like image routed thereon is shown in FIG. 2.

Figure 6:
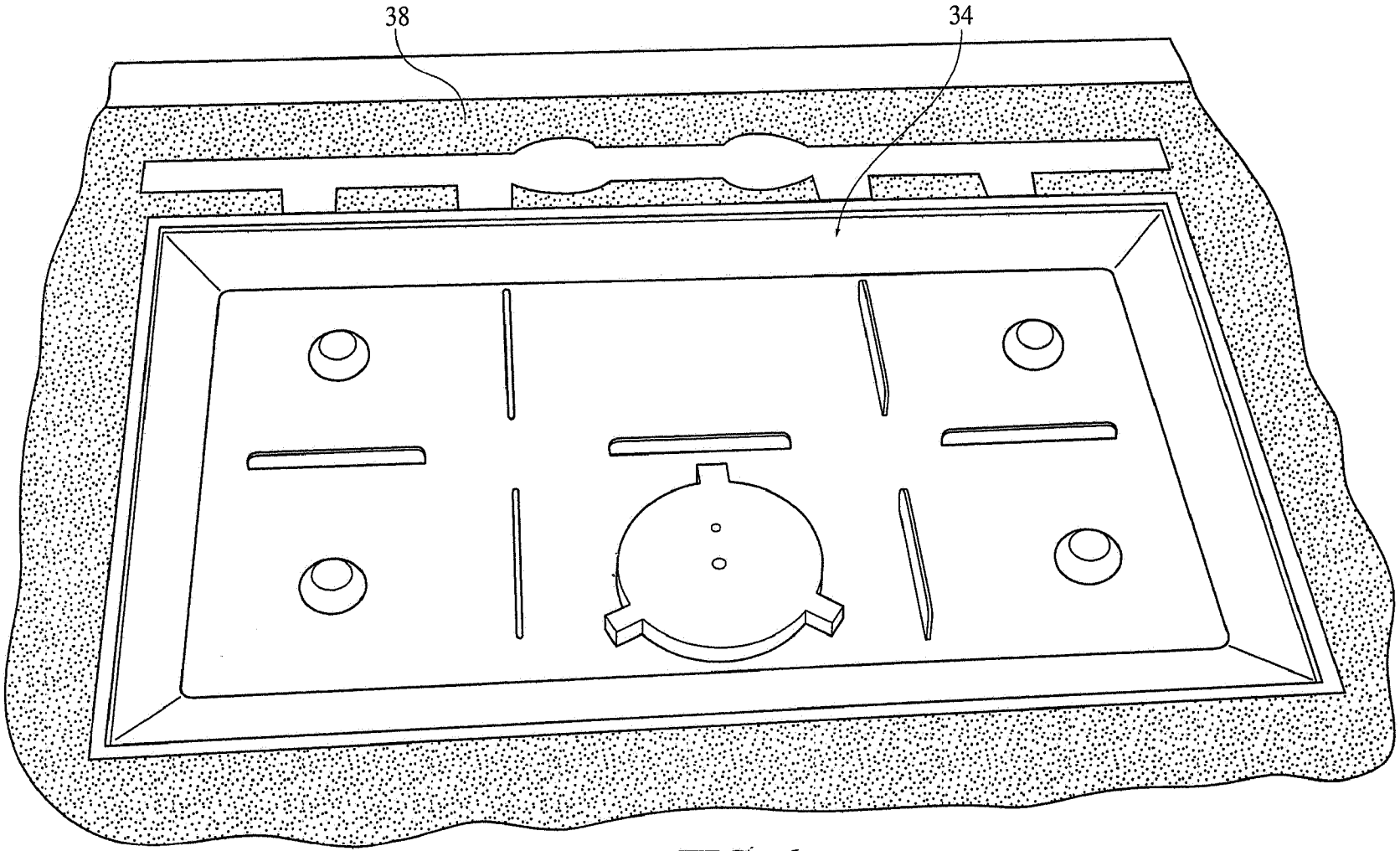
FIG. 6 is a view showing a pattern in a mold.
Figure 7:
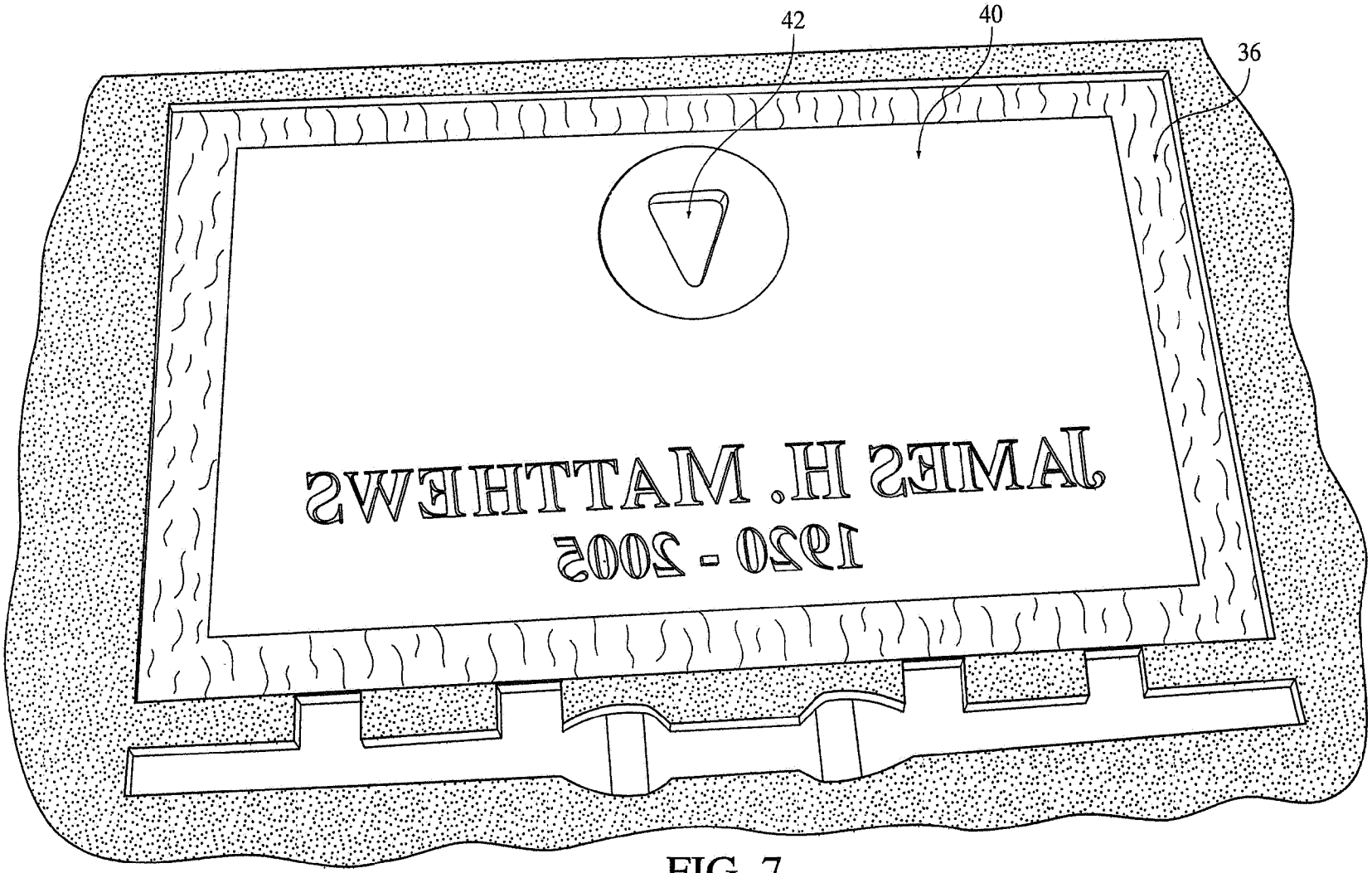
FIG. 7 is a view showing a sand filled mold after the pattern is removed.
Figure 8:
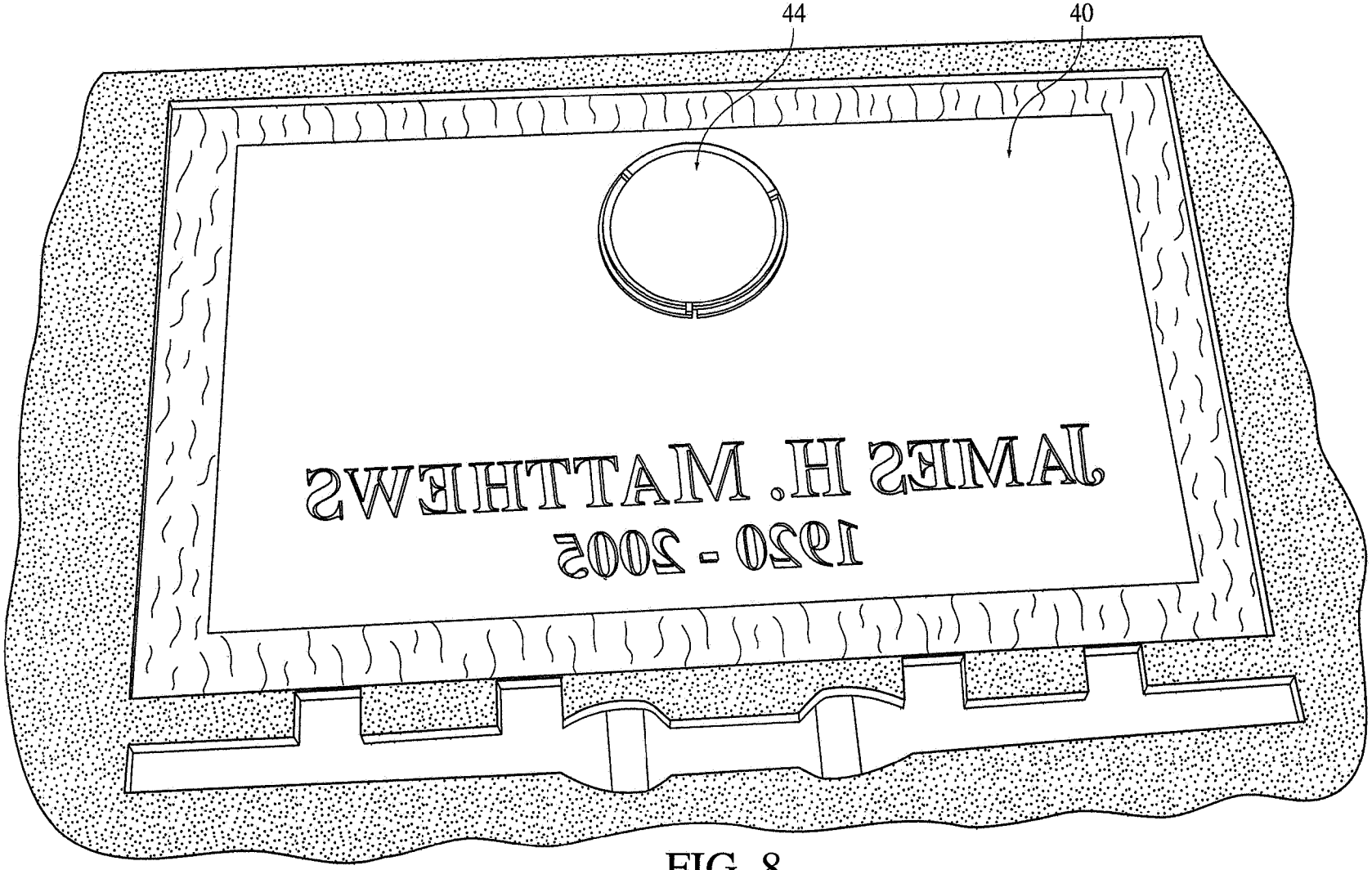
FIG. 8 is a view showing a sand filled mold after the pattern is removed and a sand core is inserted for forming a vase hole.

The pattern 16 is then used in a sand casting process using known sand casting steps (also discussed in detail with reference to FIGS. 6-8 below). The pattern is placed in a two-piece mold containing sand and additional sand is packed tightly around the pattern. The pattern 16 is removed from the mold creating a cavity in the sand. Molten metal such as bronze is introduced into the cavity to create an exact replica of the pattern 16. The present invention is not limited to bronze casting but also applies to other non-ferrous metals such as aluminum, brass, copper, or other alloys. Like the pattern, the resulting plaque has a minutely-detailed, three-dimensional, photograph-like image. After cooling, the plaque is removed from the mold. The plaque is sprayed with a tinting agent and hand-finished in order to highlight, tint and define desired areas of the image. Finally, the plaque is sprayed with a protecting agent such as a clear coat protecting finish.

The final three-dimensional image (FIG. 1) produced is not fully raised in the same manner as a bas relief representation but has both outwardly and inwardly contoured details. For example, a first detail may be contoured upwardly while an adjacent detail may be contoured downwardly. The overall appearance, however, achieves a three-dimensional quality without having a "high" profile. The resulting low profile is advantageous for use in lawn or memorial markers which may be passed over by lawn mowers.

Figure 5:
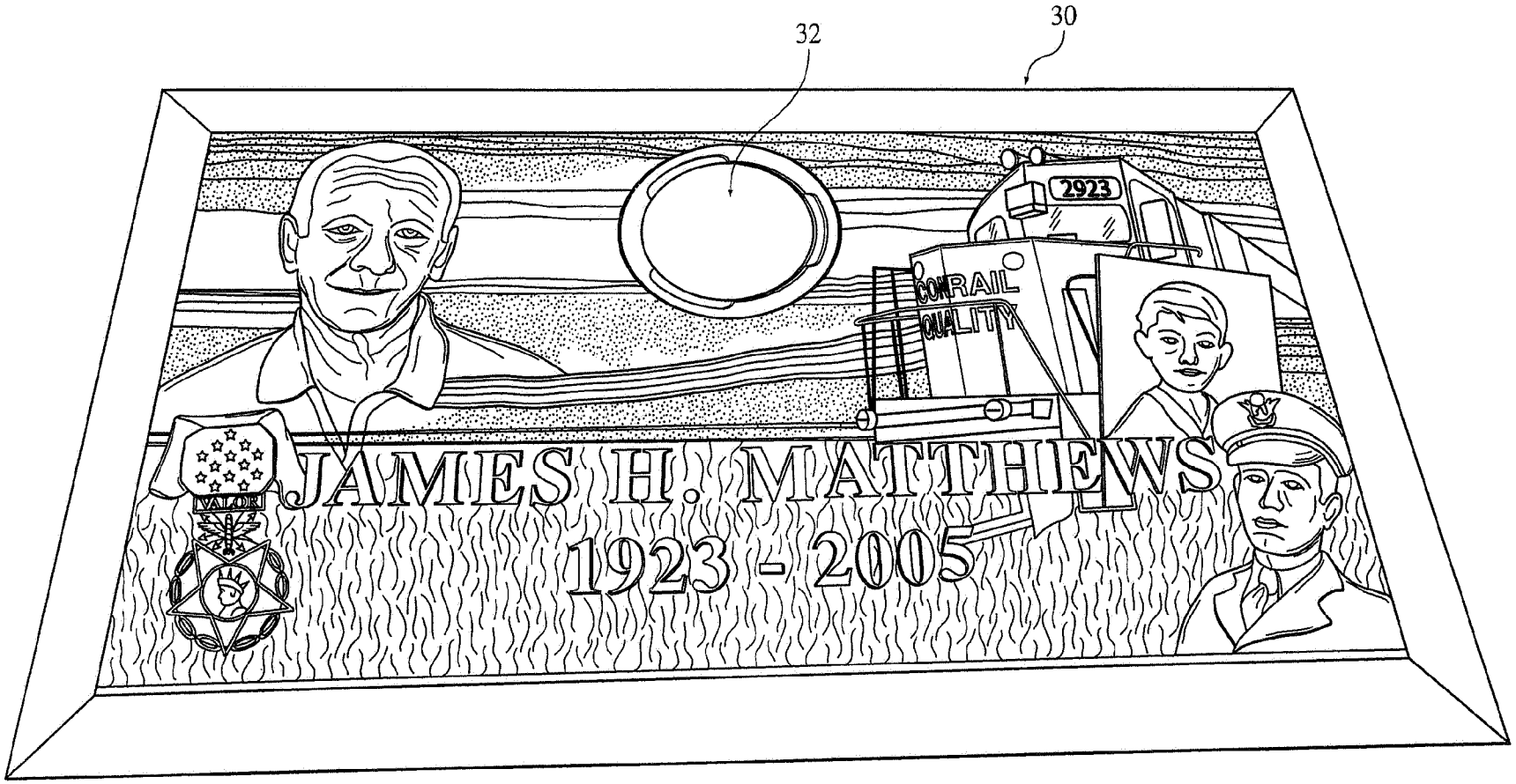
FIG. 5 is a plan view of a memorial plaque produced according to another preferred embodiment of the present invention.

A bronze memorial plaque 30 manufactured according to another preferred embodiment of the present invention is shown in FIG. 5. In this embodiment, a plaque 30 having a vase hole 32 is formed using the above-described process to form a computerized image on a pattern 34. As shown in FIGS. 6-8, a pattern 34 formed having a three-dimensional image (a detailed border in this example) is inserted (FIG. 6) and removed (FIG. 7) from the sand-filled mold 38 leaving a detailed cavity 40 having a three-dimensional image 36 in the sand and a triangular-shaped key 42. A sand core 44 (FIG. 8) is inserted into the mold using the key 42 as an orientation guide before casting to form an opening for a vase (not shown) or the like in the finished plaque. The sand core 44 includes a shaped inner rim such that the plaque opening provides a bayonet-type connection or the like with the vase. The illustrated sand core 44 is just one preferred example. Alternative sand cores may create rectangular openings, straight side-walled holes and slightly different inner rims.

Another embodiment of the present invention involves placing panels made according to the process of the present invention into frames (an example of a frame 46 is shown in FIG. 2) such that the plaque is either flush or recessed thereto. The frames may be cast metal frames or wood frames.

Figure 9:
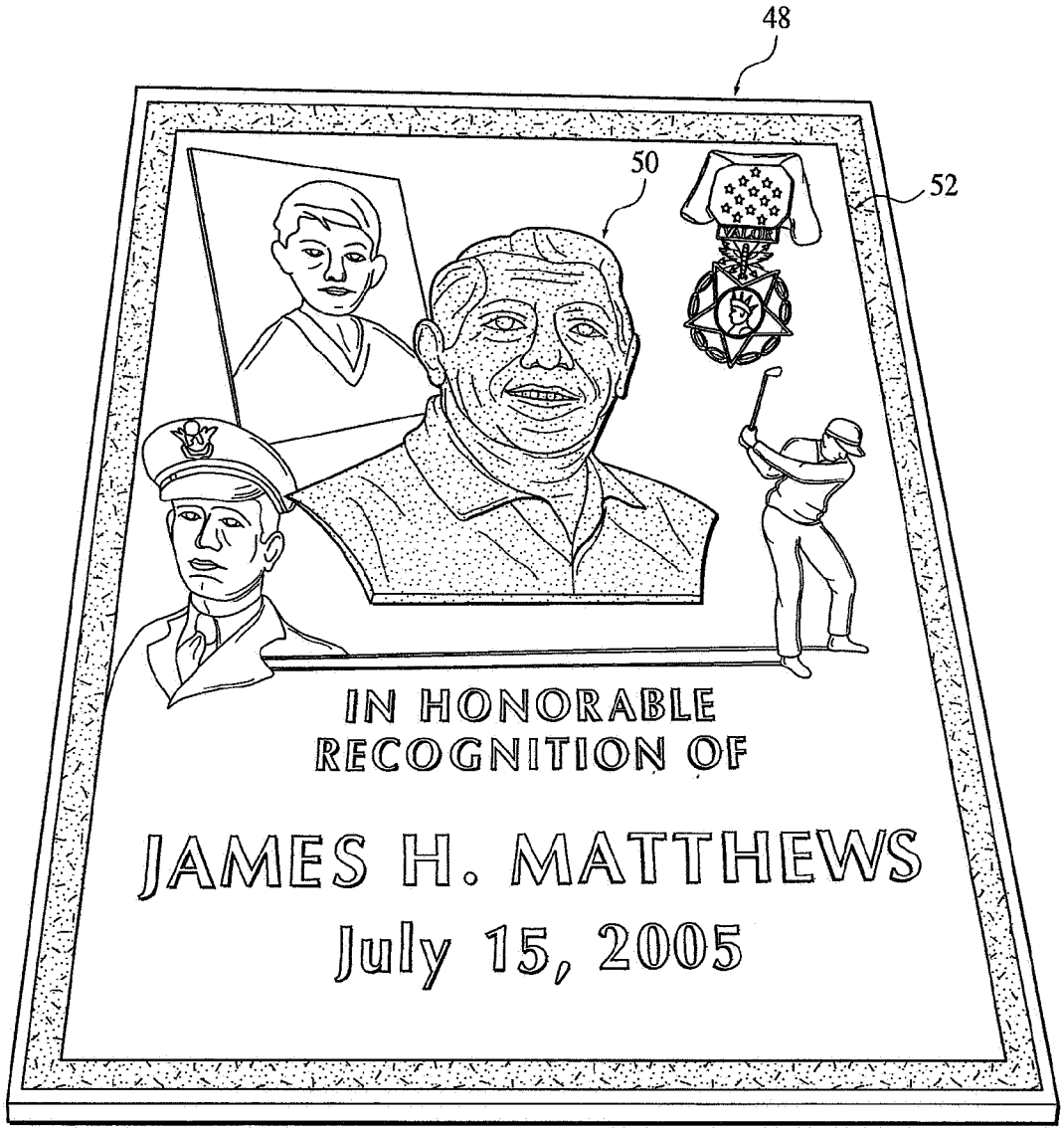
FIG. 9 is a view showing a combination pattern having bas relief molding and a minutely detailed, three-dimensional, photograph-like image.

Another embodiment of the present invention provides for a combination pattern 48 (FIG. 9) formed from the process discussed above in combination with bas relief modeling of a man's head 50 and border 52 formed from wax and affixed to the pattern. The bas relief modeling may also be formed from clay, plaster, urethane or plastic. The combination patterns may be used to cast architectural letters and signage (as illustrated in FIG. 9), as well a memorial products, in a variety of cast metals.

Figure 10:
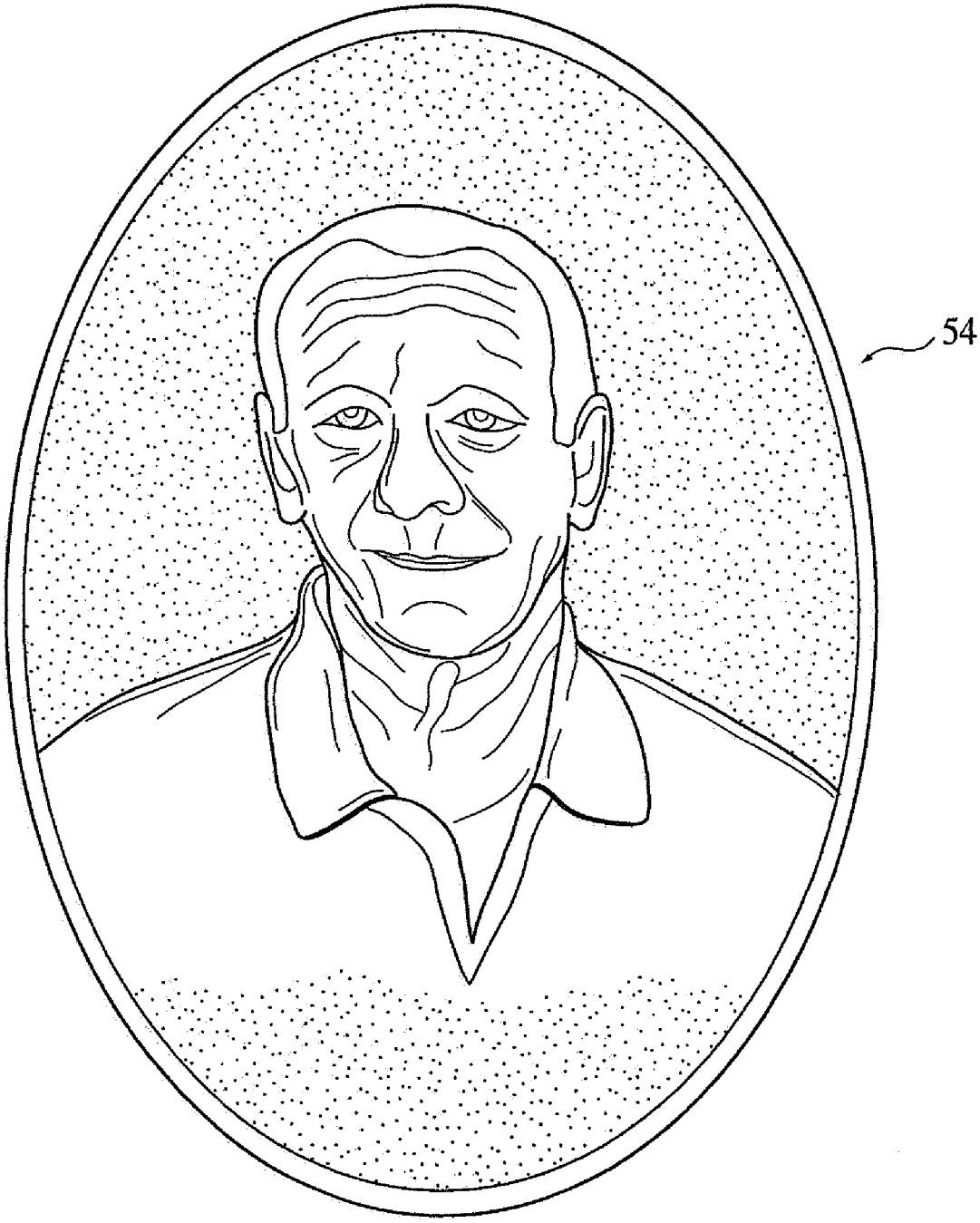
FIG. 10 is a front view a portrait panel.
Figure 11:
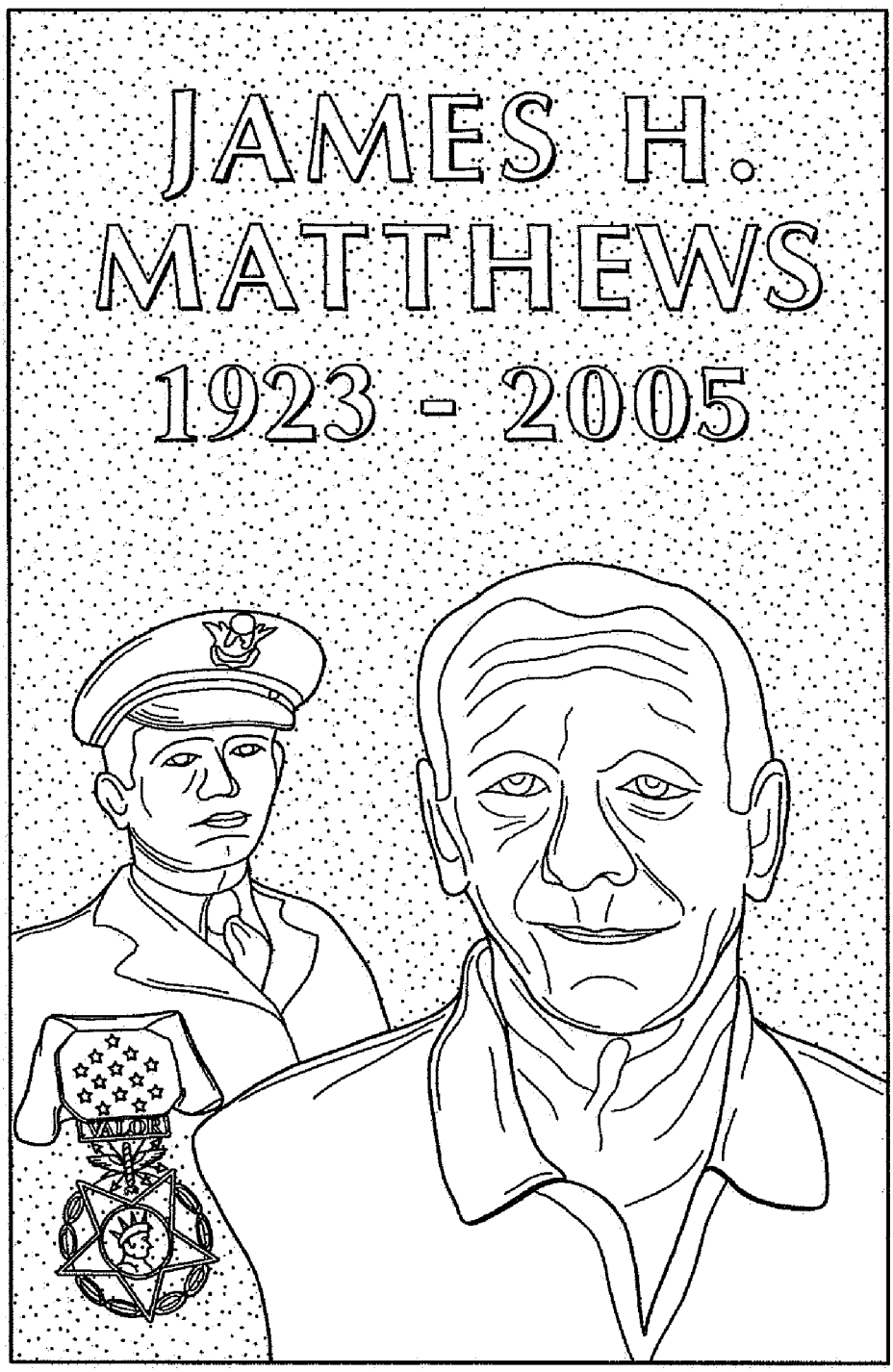
FIG. 11 is a front view showing a niche front.

The cast metal products of the present invention may be panels such as the memorial panels described above, as well as architectural panels (FIG. 9), portrait panels 54 (FIG. 10), niche fronts 56 (FIG. 11), crypt plates, crypt fronts or other types of panels made using the above described method. The crypt plates or fronts are not specifically illustrated since their design is substantially the same as the memorial plaques (FIG. 1) or niche fronts 56 (FIG. 11). The present invention further provides for cast architectural panels as discussed above or, for example, in the shape of individual letters having a minutely-detailed, three-dimensional, photograph-like image formed thereon. In this example, architectural panels may be formed according to the present invention in the form of the individual letters of the word "ZOO" having photograph-like images of zoo animals cast thereon.

Figure 12:
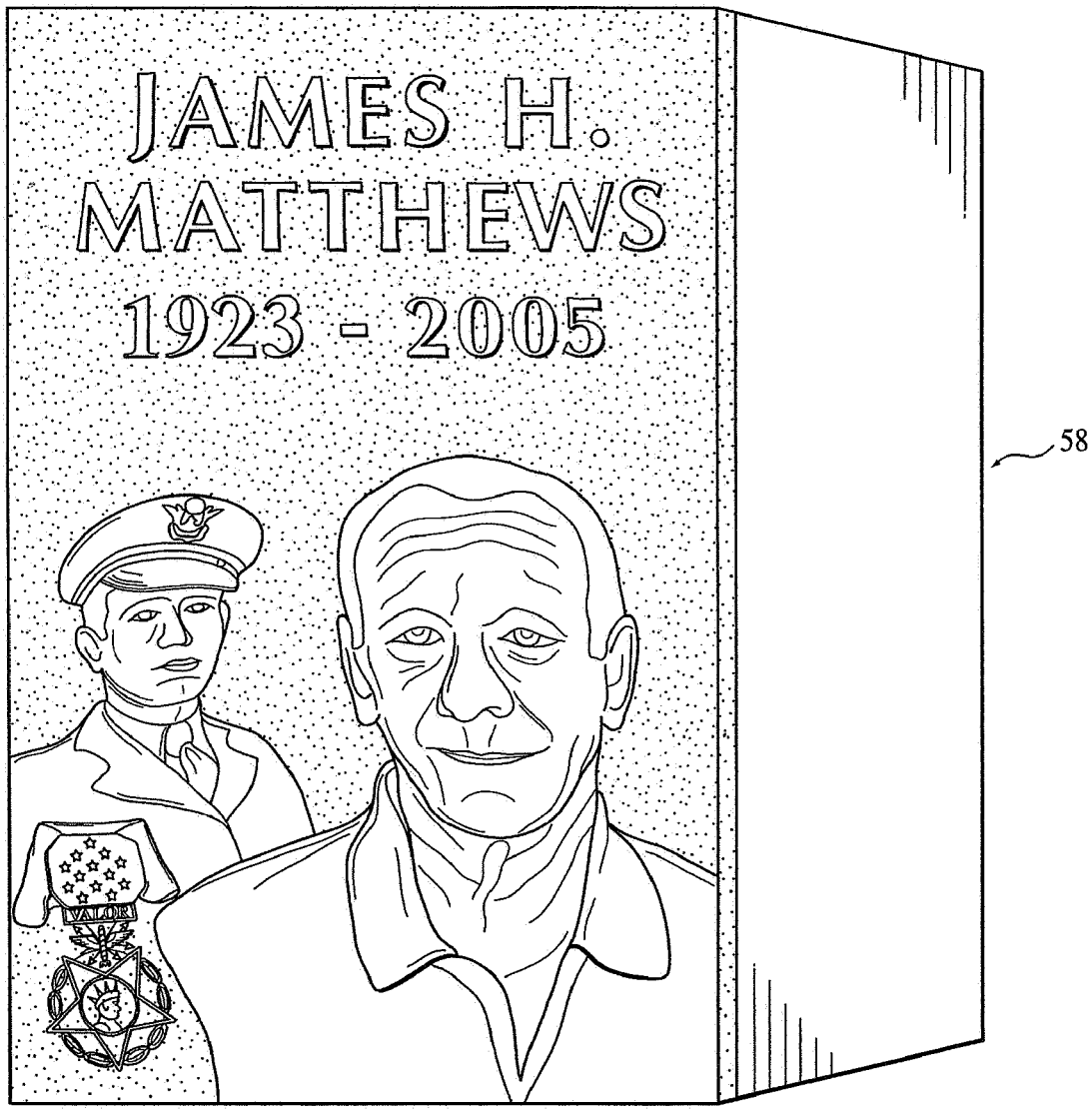
FIG. 12 is a perspective view showing a memorial urn.

Another embodiment of the present invention provides for the forming of memorial urns 58 (FIG. 12) cast integrally with a panel having a minutely-detailed, three-dimensional, photograph-like image formed thereon utilizing the process of the present invention discussed above. Alternatively, the present invention provides for a panel formed utilizing the process of the present invention discussed above and attached to a separately cast or fabricated urn.

Although the present invention has been described in detail for the purpose of illustration, it is to be understood that such detail is solely for that purpose and that variations can be made therein by those in the art without departing form the spirit and scope of the invention.

What is claimed is:

1. The method of making a cast metal product comprising:

preparing a pattern having a three-dimensional, minutely detailed, photograph-like image routed thereon, the pattern preparing step comprising:

inputting an image to a computer processor having a computer-aided manufacturing software program;

obtaining a digital representation of the image;

utilizing the software program to determine a tool path height for each digital element of the digital representation; and routing a pattern blank with a router tool utilizing a tool path determined by the software program to form a three-dimensional representation of the desired image on the pattern:

placing the pattern having a three-dimensional, minutely detailed, photograph-like image routed thereon in a sand filled mold;

packing sand around the pattern;

removing the pattern from the sand to form a cavity in the sand;

pouring liquid metal into the cavity; and allowing the metal to cool to form a metal product.

2. The method of making a cast metal product as described in claim 1, further comprising removing the metal product from the sand; applying a tinting agent to the product, and highlighting desired areas of the product.

3. The method of making a cast metal product as described in claim 1, further comprising inserting a sand core into the sand after the pattern removing step.

4. The method of claim 1, further comprising affixing bas-relief modeling to the pattern after the routing step.

5. The method of claim 1, wherein the cast metal product is selected from the group consisting of memorial plaques, architectural panels, portrait panels, niche fronts, crypt plates, crypt fronts, urns, and urn plates.

* * * * *